US005529200A

United States Patent [19]

Ford et al.

[11] Patent Number: 5,529,200

[45] Date of Patent: Jun. 25, 1996

[54] FLOATING ROOF METALLIC SHOE SEAL SPRING HANGER SYSTEM

[75] Inventors: James H. Ford, San Dimas, Calif.; Robert G. Kruger, Downers Grove; William N. Cherniwchan, Naperville, both of Ill.

[73] Assignee: Chicago Bridge & Iron Technical Services Company, Oak Brook, Ill.

[21] Appl. No.: 364,521

[22] Filed: Dec. 27, 1994

Related U.S. Application Data

[63] Continuation of Ser. No. 78,423, Jun. 16, 1993, abandoned.

[51] Int. Cl.[6] ..... B65D 87/207

[52] U.S. Cl. ..... 220/218; 220/224; 220/226

[58] Field of Search ..... 220/216, 218, 220/221, 222, 224, 226

[56] References Cited

U.S. PATENT DOCUMENTS

| | | | |
|---|---|---|---|
| 1,426,997 | 8/1922 | Leland et al. . | |
| 1,445,092 | 2/1923 | Kueffer . | |
| 1,514,116 | 11/1924 | Wiggins . | |
| 1,666,416 | 4/1928 | Griffin . | |
| 1,892,144 | 12/1932 | Griffin . | |
| 1,900,904 | 3/1933 | Berger . | |
| 1,979,657 | 11/1934 | Wiggins . | |
| 2,426,755 | 9/1947 | Ulm . | |
| 2,471,404 | 5/1949 | Boberg | 220/224 |
| 2,478,422 | 8/1949 | Plummer . | |
| 2,518,488 | 8/1950 | Moyer et al. . | |
| 2,523,292 | 9/1950 | Goldsby et al. . | |
| 2,536,019 | 1/1951 | Allen . | |
| 2,554,497 | 5/1951 | Moyer . | |
| 2,568,728 | 9/1951 | Goldsby et al. . | |
| 2,587,508 | 2/1952 | Moyer et al. | 220/224 |
| 2,649,985 | 8/1953 | Moyer . | |
| 2,685,982 | 8/1954 | Moyer . | |
| 2,696,930 | 12/1954 | Moyer . | |
| 2,740,549 | 4/1956 | Graham et al. | 220/222 |
| 2,790,574 | 4/1957 | Consani . | |
| 2,790,575 | 4/1957 | Wiggins . | |
| 2,801,763 | 8/1957 | Ulm . | |
| 2,803,371 | 8/1957 | Edens | 220/224 |
| 2,829,795 | 4/1958 | Moyer . | |
| 2,846,110 | 8/1958 | Stoyer | 220/224 |
| 2,888,161 | 5/1959 | Springer | 220/224 |
| 2,936,925 | 5/1960 | Moyer et al. . | |
| 2,960,252 | 11/1960 | Ulm | 220/224 |
| 3,019,935 | 2/1962 | Anderson, Sr. . | |
| 3,033,413 | 5/1962 | Fino et al. . | |
| 3,043,468 | 7/1962 | Horner, Jr. . | |

(List continued on next page.)

OTHER PUBLICATIONS

"Statement Regarding Threatened Patent Infringement Litigation", filed herewith, Nov. 22, 1993.

HMT Product Literature.

"Supplemental Statement of Threatened Patent Infringement Litigation", filed herewith, Sep. 6, 1994.

Letter from John P. Scherlacher to Jack R. Pine, Aug. 1, 1994 (expurgated and filed under seal).

HMT Brochure, "Metallic shoe Primary Seal" Supplemental Statement of Threatened Patent Infringement Litigation, Filed Herewith, Mar. 2, 1994.

Letter From Jack R. Pine to John P. Scherlacher, Oct. 21, 1993 (Expurgated and Filed Under Seal).

Letter From John P. Scherlacher to Jack R. Pine, Nov. 18, 1993 (Expurgated And Filed Under Seal).

*Primary Examiner*—Joseph M. Moy

*Attorney, Agent, or Firm*—Marshall, O'Toole, Gerstein, Murray & Borun

[57] ABSTRACT

The present invention relates to a ring seal for between a floating roof and a side wall in a liquid and vapor storage tank. The ring seal includes a number of overlapping shoe plates hung from the floating roof by pantagraph hanger assemblies. The pantagraph hanger assemblies urge the shoe plates against the side wall and a gap seal prevents tank vapor loss along a lap joint between adjoining shoe plates.

11 Claims, 4 Drawing Sheets

U.S. PATENT DOCUMENTS

| | | | |
|---|---|---|---|
| 3,048,298 | 8/1962 | Lessing et al. . | |
| 3,119,511 | 1/1964 | Giannini . | |
| 3,158,280 | 11/1964 | Wiggins . | |
| 3,185,335 | 6/1965 | Lecler . | |
| 3,307,733 | 3/1967 | De Bock . | |
| 3,319,329 | 5/1967 | Knutsen et al. . | |
| 3,390,803 | 7/1968 | Smith . | |
| 3,589,549 | 6/1971 | Heisterberg . | |
| 3,595,432 | 7/1971 | Van der Heijden et al. . | |
| 3,618,813 | 11/1971 | Nishkian . | |
| 3,625,415 | 12/1971 | Nelson . | |
| 3,735,891 | 5/1973 | Nishkian et al. . | |
| 3,795,339 | 3/1974 | Barbier . | |
| 4,036,395 | 7/1977 | Tuckey . | |
| 4,044,708 | 1/1977 | Boyd . | |
| 4,130,216 | 12/1978 | Creith . | |
| 4,130,217 | 12/1978 | Hills et al. . | |
| 4,154,358 | 5/1979 | Nayler et al. . | |
| 4,154,359 | 5/1979 | Bissett . | |
| 4,258,858 | 3/1981 | Russell . | |
| 4,273,250 | 6/1981 | Kinghorn, Sr. . | |
| 4,308,968 | 1/1982 | Thiltgen et al. . | |
| 4,353,477 | 10/1982 | Bruening | 220/224 |
| 4,353,748 | 12/1982 | Clark . | |
| 4,371,090 | 2/1983 | Ogarek et al. . | |
| 4,397,399 | 8/1983 | Wagoner . | |
| 4,524,878 | 6/1985 | Imhof . | |
| 4,540,104 | 9/1985 | Kawai et al. . | |
| 4,615,458 | 10/1986 | Grove et al. | 220/222 |
| 4,811,859 | 3/1989 | Kinghorn, Jr. . | |
| 5,036,995 | 8/1991 | Wagoner | 220/224 |
| 5,103,992 | 4/1992 | Lippiello et al. . | |
| 5,301,828 | 4/1994 | McKay . | |
| 5,321,881 | 6/1994 | Lippiello et al. . | |
| 5,351,848 | 10/1994 | Wagoner . | |

FLOATING ROOF METALLIC SHOE SEAL SPRING HANGER SYSTEM

This is a rule 62 file wrapper continuation of U.S. application Ser. No. 08/078,423, filed Jun. 16, 1993, now abandoned.

This invention relates generally to a ring seal for a floating roof tank and particularly to an improved pantagraph hanger for a shoe plate and a lap joint seal for a segmented shoe plate system.

BACKGROUND OF THE INVENTION

In liquid storage tanks having floating roofs, the floating roof is constructed at a slightly smaller diameter than the side wall of the tank to define an annular space that permits some freedom of movement as the roof is raised and lowered by the fluid product stored in the tank. The annular space is sealed by a mechanical ring seal of which there are a number of designs such as those disclosed in Moyer, U.S. Pat. No. 2,696,930 and Lippiello et al., U.S. Pat. No. 5,103,992.

Seals are necessary in most installations where the liquid contents vaporize and cause loss of product and pollution. Improved seals have been developed that permit the storage of liquids that are more volatile than were previously stored in floating roof tanks resulting in considerable savings over fixed roof designs.

After extended periods of use, seals tend to break down and need to be replaced. In some older designs, certain components such as shoe plates were constructed from arcuate segments fastened together to form essentially one continuous ring around the tank. To replace or repair any ring seal component, the tank had to be taken out of service because environmental concerns prohibited use of a tank containing harmful vapor without a ring seal. Taking a tank out of service is time-consuming, hazardous and expensive.

SUMMARY OF TEE INVENTION

The present invention provides improvements for ring seals that includes a system of segmented shoe plates hung by improved pantagraph hangers that can be modular for ease of installation as a replacement hanger or to supplement existing hangers and a lap joint seal that reduces vapor emissions past the ring seal.

The present invention is for a seal for a space between a floating roof and a side wall in a liquid storage tank includes a first pantagraph hanger assembly joined to the floating roof, a first shoe plate hung from the first pantagraph hanger assembly and in sliding contact with the side wall, a second pantagraph hanger assembly joined to the floating roof, a second shoe plate hung from the second pantagraph hanger assembly and adjacent to and defining a sliding lap joint with the first shoe plate, and a clip plate fixed to the first shoe plate to define a resilient recess for slidably receiving the second shoe plate at the lap joint.

The seal also includes a flexible sheet material joined to the floating roof and to the first and second shoe plates to at least partially seal the space between the floating roof and the side wall, the flexible sheet defining a gap at the sliding lap joint of the first and second shoe plates, and a gap seal positioned in the flexible sheet gap to reduce vapor emissions through the gap, the gap seal includes a flexible retainer strap spanning the lap joint and secured to the first and second shoe plates to define a sleeve, and a resilient material packed in the sleeve to substantially reduce the emission of vapor through the sleeve.

The pantagraph hanger assembly may include a base member fixed to the floating roof, a pantagraph arm having a first end hinged to the base member and a second end free to pivot about the first end, a hanger arm hinged to the pantagraph arm in an x-shaped configuration for scissor-like movement with the pantagraph arm, and having a first end hinged to a respective shoe plate, and a second end slidably bearing on the base member, and a coil spring compressed between the base member and the pantagraph arm to urge the second end of the pantagraph arm to pivot and the first end of the hanger arm away from the base member.

The coil spring in the pantagraph arm may be replaced by a torsion spring having a first leg bearing on the base member and a second leg bearing on the first end of the pantagraph arm to urge the second end of the pantagraph arm to pivot and thus urge the first end of the hanger arm away from the base member.

Also provided by this invention is a modular pantagraph hanger assembly for urging a shoe plate from a floating roof of a liquid storage tank including a base member having means for being fixed to the floating roof, a pantagraph arm having a first end hinged to the base member and a second end free to pivot about the first end, a hanger arm hinged to the pantagraph arm in an x-shaped configuration for scissor-like movement with the pantagraph arm, and having a first end for applying a force on a shoe plate, and a second end slidably bearing on the base member, a coil spring compressed between the base member and the pantagraph arm for urging the second end of the pantagraph arm to pivot and the first end of the hanger arm away from the base member.

The base member may be a channel having a web and two flanges extending outwardly toward the pantagraph and hanger arms. The base member may include a wing opposing a tube socket on the pantagraph arm, and the compression spring is compressed between the wing and the tube socket.

The base member may have a slot for receiving a pin on the second end of the hanger arm for sliding engagement.

Another modular pantagraph hanger assembly for urging a shoe plate away from a floating roof of a liquid storage tank includes a base member having means for being fixed to the floating roof, a pair of substantially parallel pantagraph arms each having first ends hinged to the base member and each having second ends free to pivot about the hinged first ends, a hanger arm interposed between and hinged to the pantagraph arms in an x-shaped configuration for scissor-like movement with the pantagraph arms, and having a first end for applying a force to a shoe plate and a second end slidably bearing on the base member, and a pair of compression springs, one each compressed between the base member and a respective pantagraph arm for urging the second ends of the pantagraph arms to pivot and the first end of the hanger arm away from the base member.

The base member may be a channel having a web and two flanges extending outwardly. Wings may be joined to opposite sides of the base member and a tube socket may be joined to each wing, each tube socket opposes a wing joined to each pantagraph arm for receiving a coil spring therebetween.

The base member may define a slot for receiving a pin joined to the second end of the hanger arm for sliding engagement.

A modular pantagraph hanger assembly in accordance with the present invention for urging a shoe plate away from a floating roof of a liquid storage tank may include a base member having means for being fixed to the floating roof, a pantagraph arm having a first end hinged to the base member and having a second end free to pivot about the first end, a hanger arm hinged to the pantagraph arm in an x-shaped configuration for scissor-like movement with the pantagraph arm, the hanger arm having a first end for applying a force to a shoe plate and a second end slidably bearing on the base member, and a torsion spring having a first leg bearing on the base member and a second leg bearing on the first end of the pantagraph arm to urge the second end of the pantagraph arm to pivot and the first end of the hanger arm away from the base member.

The base member may be a channel and the pantagraph arm may also be a channel with flanges partially interposed between the flanges of the base member channel.

The torsion spring may be coaxial with the hinged connection of the base member and the pantagraph arm.

A seal for a space between a floating roof and a side wall in a liquid storage tank including first and second shoe plates hung from the floating roof and positioned adjacent one another to define a sliding lap joint therebetween, and a pantagraph assembly joined to the floating roof and applying a force to the lap joint to urge the first and second shoe plates toward the side wall. A clip plate may be fixed to the first shoe plate to define a resilient recess for slidably receiving the second shoe plate at the lap joint.

BRIEF DESCRIPTION OF TEE DRAWINGS

Figure 5:
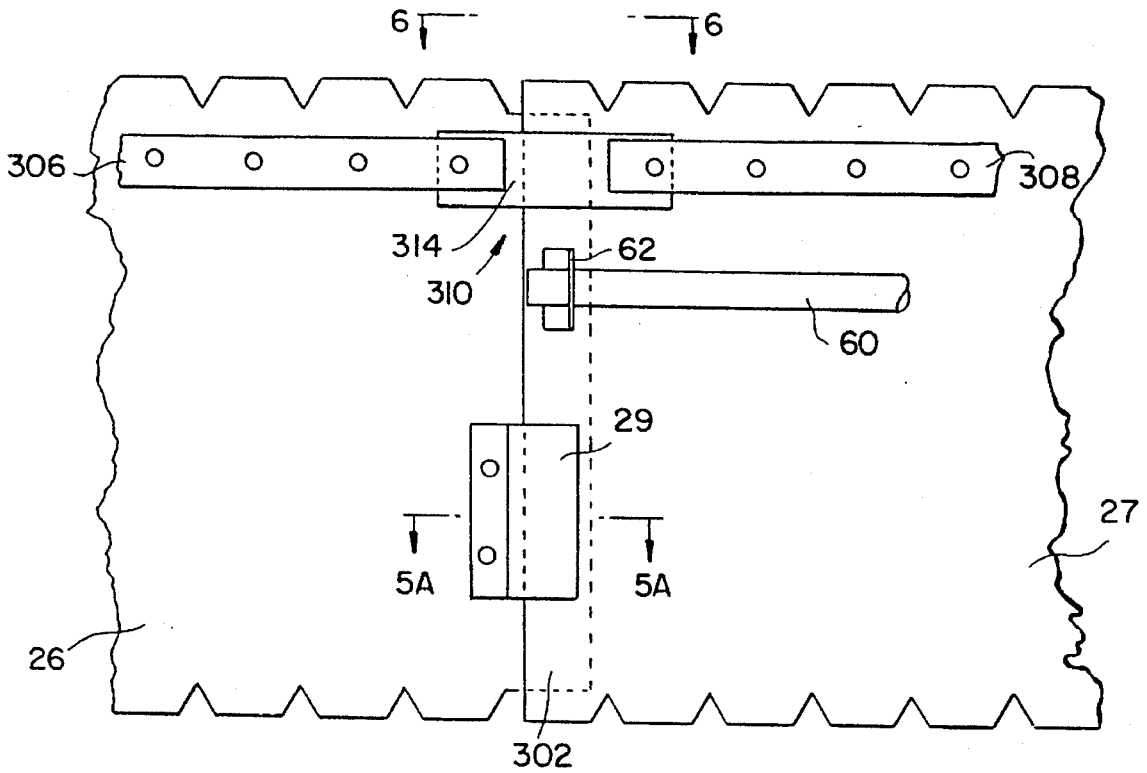
FIG. 5 is a partial elevational view of a sliding lap joint between two shoe plates.
Figure 5A:
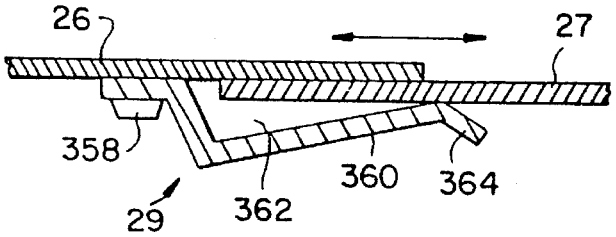
Figure 6:
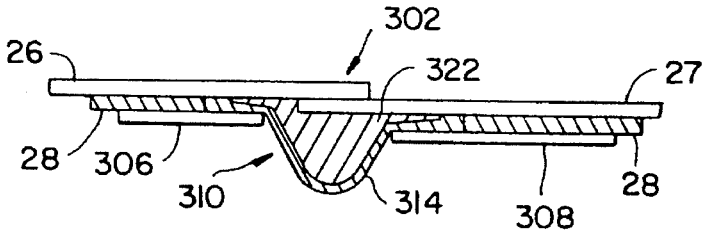

FIG. 5*a* is a cross-sectional view taken along lines 5*a*—5*a* of the clip plate illustrated in FIG. 5; and FIG. 6 is a cross-sectional view of the lap joint of FIG. 5 taken along line 6—6.

DETAILED DESCRIPTION OF THE DRAWINGS

To the extent reasonable and practical, the same or similar elements in the various views of the drawings will be identified by the same numbers.

Figure 1:
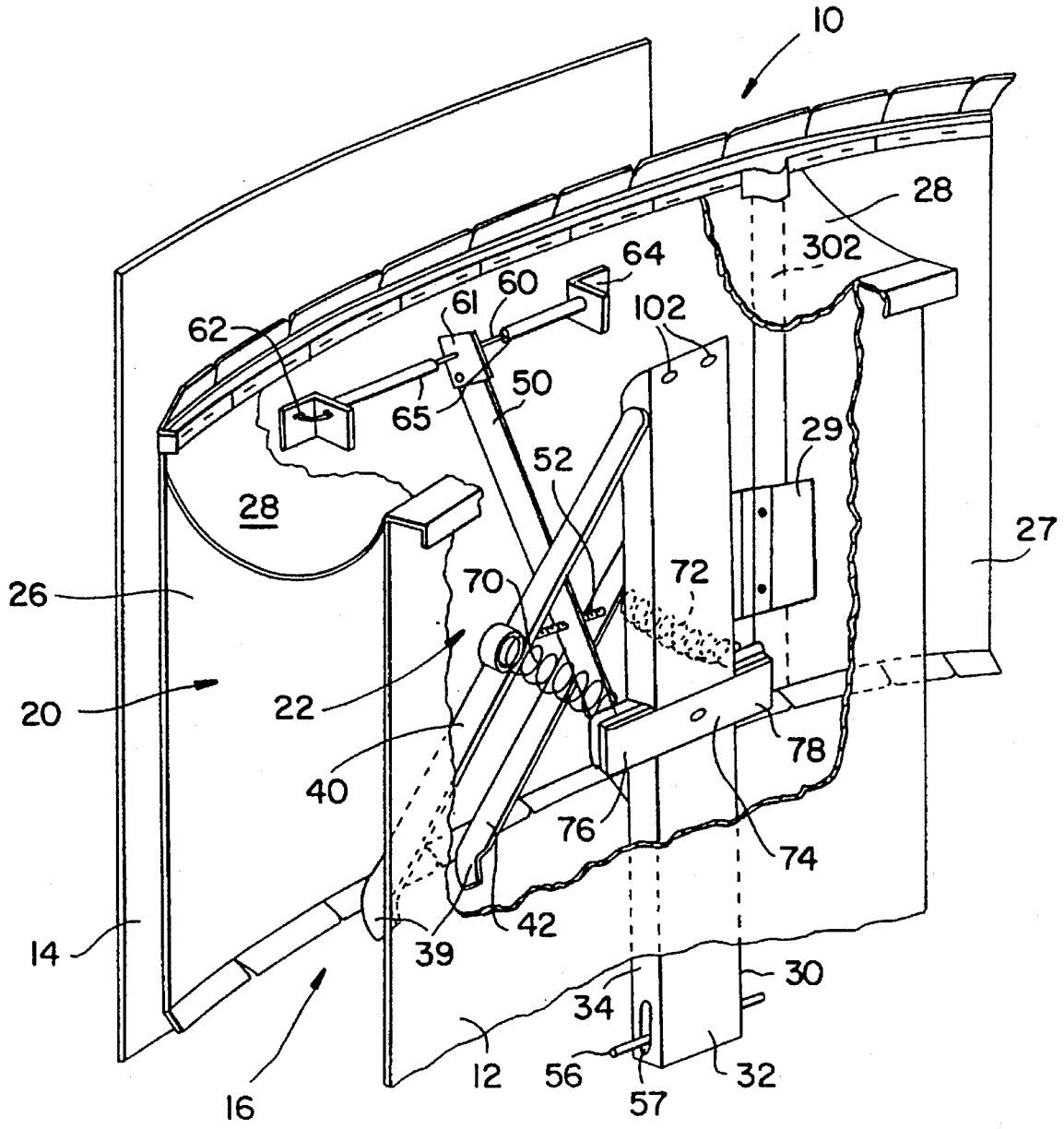
FIG. 1 is a partial perspective view of a floating roof with a pantagraph hanger assembly and a shoe plate lap joint seal in accordance with the present invention.

FIG. 1 illustrates a section of a floating roof tank 10 having a floating roof 12 and a side wall 14 both of which are typically circular when viewed in plan. The floating roof 12 has a slightly smaller diameter than the side wall 14 and that results in an annular space 16 being defined between the two. The size of the annular space 16 at any given point on the circumference of the tank 10 varies depending upon the position of the floating roof 12 within the tank 10 because the floating roof 12 will float from side to side as the liquid level within the tank 10 rises and falls or as weather conditions outside of the tank move the roof 12 from side to side.

The annular space 16 must be sealed to minimize the release of pollution-causing vapors of the stored liquid from escaping to the atmosphere and thereby loss of product, and also to minimize rain or snow from seeping into the tank 10. Consequently, a ring seal 20 must be provided to seal the annular space 16 while accommodating lateral and vertical movement of the floating roof 12.

The ring seal 20 in FIG. 1 includes a modular pantagraph hanger assembly 22 that is connected to the floating roof 12 to support a first shoe plate 26 that is also urged outwardly by the pantagraph hanger assembly 22 to slidably engage the side wall 14 of the tank 10. In most installations, three pantagraph hanger assemblies are used, but for simplicity, only one hanger assembly 22 per shoe plate is illustrated and described. The shoe plate 26 extends below the level of the liquid product in the tank 10 so that the majority of vapor that is emitted by the liquid product is emitted into the annular area 16 of the ring seal 20 where it is trapped and stored. An adjoining second shoe plate 27 is positioned to the right of the first shoe plate 26. The first and second shoe plates 26 and 27 define a sliding lap joint 302 that permits circumferential sliding relative to one another as the local dimension of the annular space 16 varies with movement of the floating roof 12.

The use of a number of shoe plate segments in a circumferential sliding relationship is beneficial because stress and distortion associated with movement of the floating roof relative to the side wall need not be withstood by a continuous shoe plate ring that must bend or conform to the side wall. Rather, a number of shoe plates sliding against one another can adjust to movement of the floating roof 12 with substantially improved sealing contact between the shoe 26 and the side wall 14 since the shoe does not need to deform.

A clip plate 29 maintains close contact between adjacent overlapping shoe plates to avoid vaporized product from escaping between the sliding lap of the adjacent shoes from the annular space 16. The shoes are also bent radially inwardly at the top and bottom so that they will tend to slide over imperfections on the inner surface of the side wall 14.

Spanning the annular space 16 is a flexible sheet 28 of fabric that is impervious to the vapors in the annular space 16. The sheet is attached around the circumference of the floating roof 12 and is draped over the annular space 16 and secured to the shoe plate 26. Slack in the flexible sheet 28 is desirable to accommodate movements of the floating roof 12 relative to the shoe plate 26.

Figure 2:
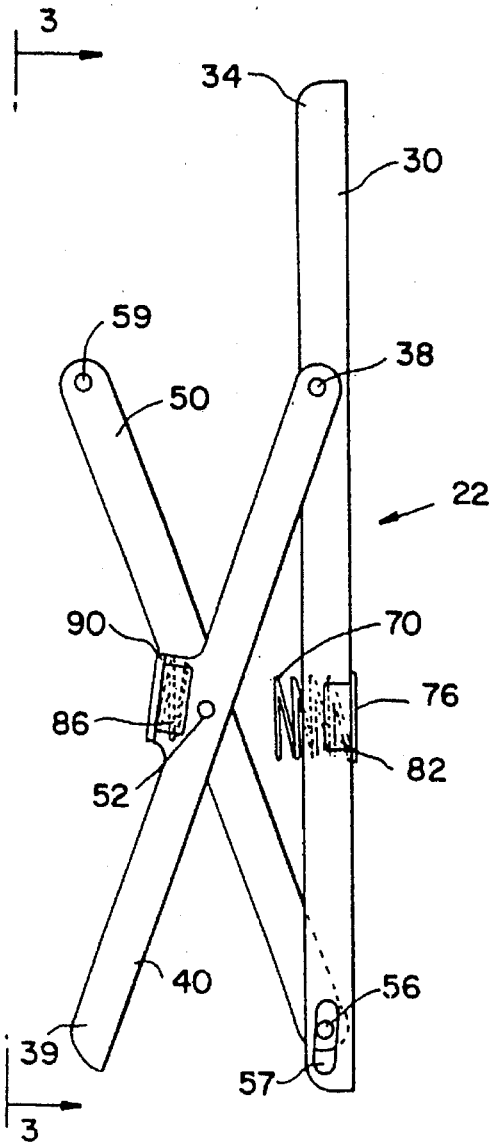
FIG. 2 is a side elevational view of a modular pantagraph hanger assembly.
Figure 3:
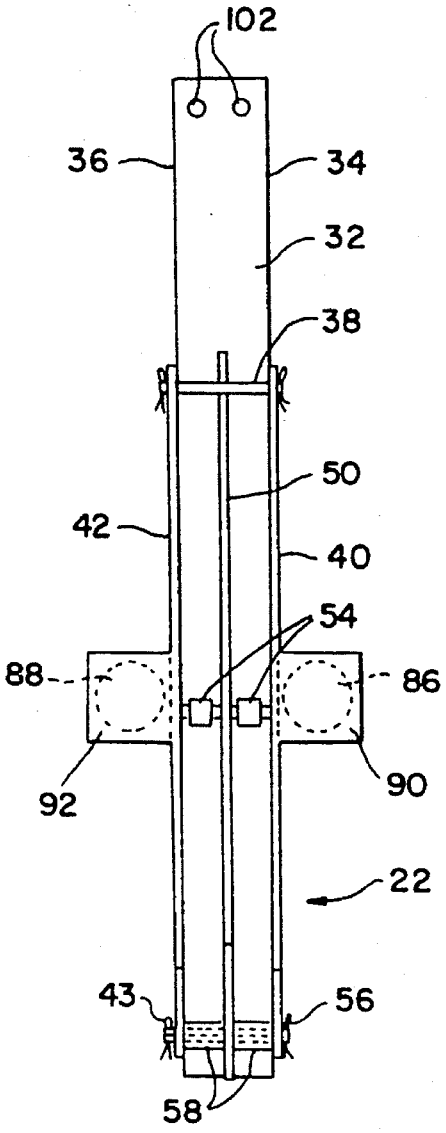
FIG. 3 is an elevational view of the pantagraph hanger taken along line 3—3 in FIG. 2.

The pantagraph hanger assembly 22 is preferably modular which greatly simplifies installation, removal and repair. As seen in FIGS. 1 through 3, the modular pantagraph hanger assembly 22 includes a substantially vertical base member 30 for connection to the floating roof 12. The base member 30 is preferably a channel having a web 32 and two parallel flanges 34 and 36 on opposite sides of the web 32 extending outwardly from the floating roof 12 toward the shoe plate 26.

A pair of parallel pantagraph arms 40 and 42 each have first upper ends hinged to the base member 30 at the flanges 34 and 36 respectively by a hinge pin 38. The pantagraph arms 40 and 42 have second lower ends 39 that are free to pivot about the hinged first ends. The lower ends 39 are preferably rounded and spaced apart from the shoe plate 26 under normal operating conditions. However, if the tank 10 becomes overfilled with product and the floating roof 12 floats partially above the side wall 14, the shoe plate 26 will lean against the top of the side wall 14 and begin to rotate about its upper end to bring the lower portion of the shoe plate 26 into contact with the lower portion 39 of the pantagraph arms 40 and 42 thereby preventing the ring seal 20 of the floating roof 12 from tipping over the edge of the side wall 14.

Between the pantagraph arms 40 and 42 is positioned a hanger arm 50 that is hinged to the pantagraph arms 40 and 42 in an x-shaped configuration by a rod 52 for scissor-like movement with the pantagraph arms 40 and 42 when the floating roof 12 is moving with respect to the side wall 14. The rod 52 is held in place in such a manner as to permit rotation of the arms. Rod 52 is welded to the arms 40 and 42.

The hanger arm 50 is spaced apart from both the pantagraph arms 40 and 42 by spacers 54 (FIG. 3). The lower end of the hanger arm 50 is fitted with rod 56 that can slide in vertical slots 57 defined by the flanges 34 and 36 at the bottom of the base member 30 (FIG. 2). Alternatively, the lower end of the hanger arm 50 can simply bear on the base member 30 or on the floating roof 12 and slide vertically in a bearing relationship. The rod 56 has a centering spacer 58 (FIG. 3) on each side of the hanger arm 50 and adjacent the base flanges 34 and 36. Sliding action is necessary to compensate for the varying vertical spacing of the lower end of the hanger arm 50 and the upper ends of the pantagraph arms 40 and 42 during movement of the floating roof 12.

The upper end of the hanger arm 50 acts on the shoe plate 26 to force it against the side wall 14. A hole 59 (FIG. 2) in the hanger arm 50 can be hinged to the shoe plate 26 by a rod 60 that is supported at its ends by L-shaped brackets 62 and 64. Spacers 65 (FIG. 1) prevent excessive sliding of the hanger arm 50 along the rod 60 and preferably limit horizontal movement to acceptable levels.

Further, it is desirable to insert an electrical insulator at some point along this connection because static electricity that results from rubbing of the shoe plate 26 on the ring wall 14 or a lightning strike may cause arcing along the pantagraph hanger assembly 22 and sparks in the annular space 16 which could ignite the vapors being stored there. Preferably the insulator is in the form of a clam shell-shaped plastic sleeve 61 that wraps the end of the hanger arm 50 and includes a hollow post (not illustrated) that fits through a hole in the upper end of the hanger arm 50. The rod 60 then slides through hollow post and is electrically insulated from the hanger arm 50.

It is also desirable to space bracket 62 apart from bracket 64 to distribute the point load applied by the upper end of the hanger arm 50 to the points where the brackets 62 and 64 are positioned. Such load distribution is more effective for conforming the shoe plates outwardly against the side wall 14 than a single load. Further, joining bracket 62 to the left edge of the second shoe plate 27 could apply a load to the lap joint between the first shoe plate 26 and the second shoe plate 27 to help maintain the shoe plates in sliding contact for improved sealing by the ring seal system.

As stated above, the hanger assembly 22 can replace old hangers or can be installed adjacent to old hangers to put supplemental pressure on shoe plates 26 to improve their sealing efficiency. Typically, three hanger assemblies are used to support a twelve foot long shoe plate. In supplemental installations the rod 60 that distributes the load along the shoe plate 26 will tend to be shorter than the original installations because there is less space along the shoe plate 26 for a long rod and there is less need to distribute the load widely since the pressure is only needed locally.

Further, where the pantagraph assembly is only being used to supplement an existing hanger, it is not necessary that the upper end of the hanger arm 50 be hinged to the shoe plate 26. It is only necessary that the upper end of the hanger arm 50 be provided with a bearing plate (see FIG. 4 for example) for applying a load to the shoe plate 26 where necessary. The connection between the base member 30 to the floating roof 12 will be adequate to maintain the desired position of the hanger assembly 22.

To urge the lower ends 39 of the pantagraph arms 40 and 42 to pivot about the upper ends of the pantagraph arms and to urge the upper end of the hanger arm 50 away from the base member 30, coil springs 70 and 72 are compressed between the base member 30 and the pantagraph arms 40 and 42. Preferably, a wing plate 74 is provided that is fixed to the web 32 of the base member 30 to define wings 76 and 78. On the wings 76 and 78 are mounted tube posts 82 and 84 which oppose tube posts 86 and 88 mounted on pantagraph wings 90 and 92 extending from the side of each pantagraph arm 40 and 42. The coil springs 70 and 72 fit onto the tube posts which are of a smaller diameter than the inside diameter of the coil springs 70 and 72, to prevent slippage and to ensure efficient transfer of the spring load to the pantagraph arms 40 and 42. Alternatively, any of the tube posts could be tube sockets that are sized larger than the outside diameter of the spring 70 to receive the spring 70 and confine the spring end to prevent slippage and optimize load transfer. Preferably, the wings 90 and 92 on the pantagraph arms are oriented at an angle to the pantagraph arms so that they are maintained substantially vertically, as illustrated in FIG. 2. This enables the coil springs 70 and 72 to act normal to the wings 90 and 92 for reduced slippage and improved efficiency.

Coil springs are advantageous because they can be installed from the top while the tank is in service and they remain above the liquid product in the tank during operation to minimize the corrosive effects on the spring. Further, they have no sharp bends or stress concentration points that could lead to premature failing of the spring.

Coil springs also provide a mechanical advantage because they apply a force perpendicular to the shoe plate 26 rather than at angles relative to the shoe plate 26 that are inefficient. This is particularly true when the coil springs are positioned at the same elevation as the x-shaped intersection of the pantagraph arms 40 and 42 and the hanger arm 50. Further, coil spring geometry can result in a smaller stress range during operation which increases the useful life over other spring configurations.

The modularity of the pantagraph hanger 22 provides a number of advantages for replacement and supplementation of existing ring seals. A modular pantagraph hanger requires a minimum of field assembly since the coil springs can be removed to fold the pantagraph hanger 22 nearly flat for shipment. Compression springs can easily be compressed by hand and inserted into tube sockets or onto tube posts and the rod 56 positioned into the slot 57 on the base member 30 to prepare the pantagraph hanger 22 for installation.

To install the pantagraph hanger assembly 22, it is compressed by hand to fit within the annular space 16. The base member 30 is positioned adjacent to the floating roof 12 and need only be bolted at its top end through bolt holes 102 that are either existing or are punched at desirable points on the floating roof 12. This arrangement provides easy access for workmen from above and eliminates the need for welding which can be hazardous or impossible if the vapor within the tank 10 is flammable. When using the hanger assembly 22 as a supplement for an existing hanger the upper end of the hanger arm 50 may be equipped with a bearing plate that can simply rest on the shoe plate 26.

When using the assembly 22 as a shoe plate hanger, the upper end of the hanger arm 50 can be bolted through bolt hole 59 and optional insulator 61 with slip washers (not illustrated) to rod 60. Again, this provides easy access and requires no welding.

The pantagraph hanger 22 is preferably installed in the vertical orientation illustrated in the figures, but due to the modular nature of the hangers, they could be installed in any orientation including horizontally if desired or if unusual conditions or spacing require it. Further, it may not be necessary to provide two pantagraph arms if one spring is adequate to pressure the shoe plate 26 against the ring wall 14. When only one spring is required then only one pantagraph arm may be needed.

Figure 4:
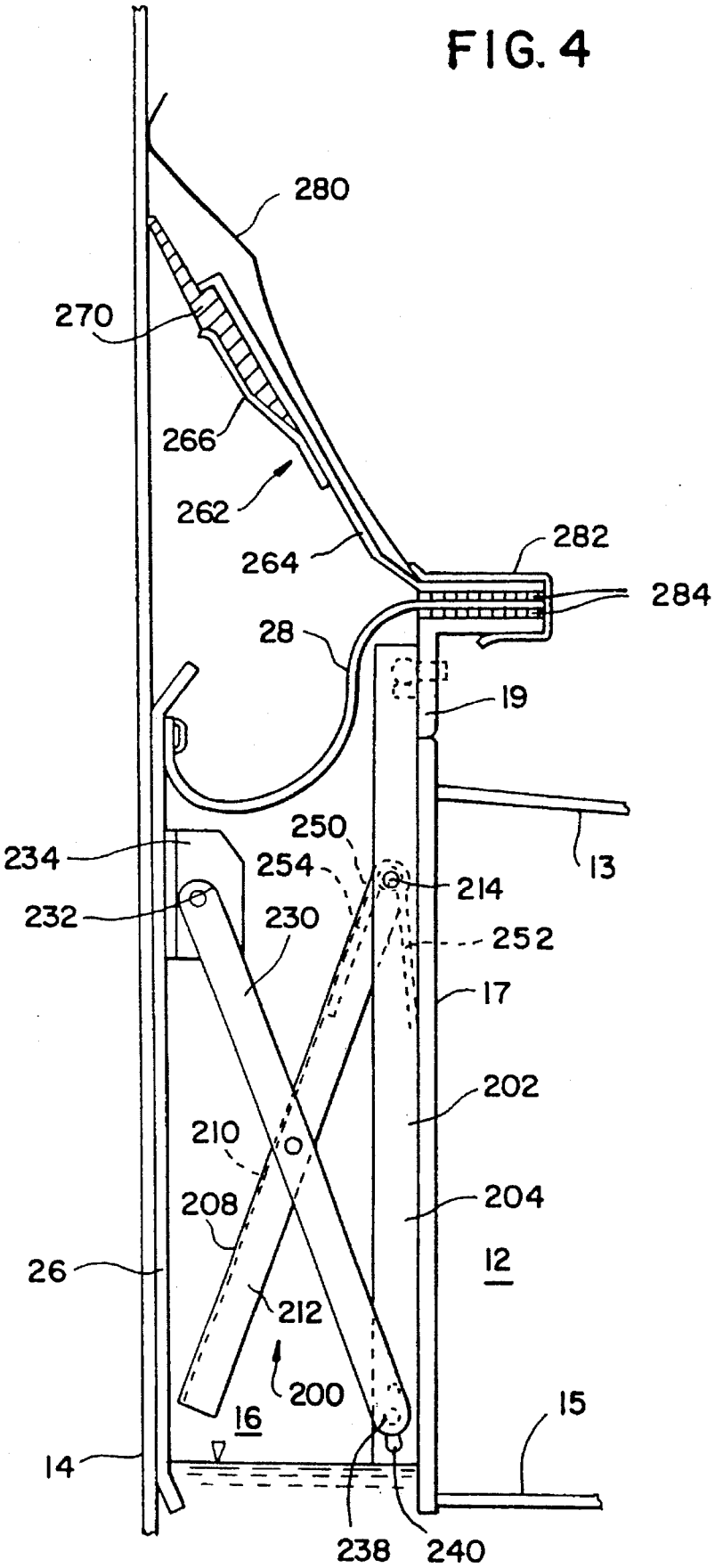
FIG. 4 is an alternative pantagraph assembly in accordance with the present invention.

FIG. 4 illustrates an alternative modular pantagraph assembly 200 positioned in the annular space 16 between the floating roof 12 and the side wall 14. The construction of the floating roof 12 includes an optional upper deck 13 and a lower deck 15 that are joined at their periphery by a rim plate 17. An optional rim angle 19 is welded to the top of the rim plate 17. Liquid product is illustrated near the bottom of the floating roof rim plate 17 and above the bottom of the shoe plate 26.

A base member 202 is oriented vertically, adjacent the rim plate 17 and is bolted to the rim angle 19, if present, or to the rim plate 17 through existing holes or holes punched as needed. The base member 202 is made of a channel section that has a web (not illustrated) and two parallel flanges 204 extending outwardly from the web, away from the floating roof 12.

A pantagraph arm 208 is also formed from a section of channel having a web 210 and two parallel flanges 212 extending from the web 210 and toward the base member 202. The pantagraph arm channel 208 is preferably sized to fit within the flanges 204 of the base member channel 202 for convenient pin connection 214 at the upper ends of the flanges of both channels 202 and 208. The lower end of the pantagraph arm 208 is left free to pivot about the pinned upper end.

A hanger arm 230 is hinged to the flange 212 of the pantagraph arm 208 in an x-shaped configuration for scissor-like movement with the pantagraph arm 208. Preferably a second parallel hanger arm (not illustrated) is hinged to the opposite side of the pantagraph arm 208 to balance any eccentric loading that may result from using a single hanger arm with a relatively wide channel-shaped pantagraph hanger.

The upper end of the hanger arm 230 is hinged by a rod 232 to an angle bracket 234 connected to or bearing on the shoe plate 26. The lower end of the hanger arm is slidably bearing on the base member 202 by a pin 238 received into a slot 240 defined by the base member 202. In some installations the rod and slot may not be necessary and the lower end of the hanger arm 230 may simply bear on the base member 202 for sliding engagement therewith.

A torsion spring 250 (illustrated in dashed lines) is positioned coaxially with the pin 214 and has a first leg 252 bearing on the web of the base member 202 and a second leg 254 bearing on the web 210 of the pantagraph arm 208 to urge the lower end of the pantagraph arm to pivot and the upper end of the hanger arm 230 to move away from the base member 202 and deliver an outward force to the shoe plate 26.

The torsion spring 250 is advantageous for this embodiment because it is positioned well-above the liquid product level of the tank 10 and acts efficiently against the webs of the base member 202 and the pantagraph arm 208 while being restrained from sliding off by the flanges of these members. Alternatively, one or more coil springs could be used in the arrangement as described above in the FIG. 1 embodiment.

Also illustrated in FIG. 4 is the flexible impervious sheet 28 joined to the shoe plate 26 and to the rim angle 19, if present, and the rim plate 17, if not, with enough slack to accommodate lateral movement of the floating roof 12 relative to the side wall 14.

An optional secondary seal 262 is shown above the flexible sheet 28. The secondary seal 262 includes a spring arm 264 cantilevered from the rim angle 19. A clamp plate 266 joined to the spring arm 264 retains a flexible wiper 270 that is kept in wiping contact with the side wall 14 by the downward force exerted by the spring arm 264. The secondary seal 262 is preferably constructed of arcuate segments around the perimeter of the floating roof 12.

A shunt 280 is joined to the rim angle 19 by a metallic clip 282 and in resilient wiping contact with the side wall 14 to provide an electrical path for static or lightning induced electricity from the floating roof 12 to the side wall 14. Should any arcing result from the flow of electricity it will then take place near the shunt 280 and away from the vapor stored in the annular space 16.

The flexible sheet 28, the optional spring arm 264, and the shunt 280 are all preferably compression clipped to the rim angle 19, if present, by a clip 282 with the aid of gaskets 284 that both seal the connection and provide resilience to maintain the compression at the clip 282.

As described above, only extremely small quantities of volatile vapor can escape from between the shoe plate 26 and the side wall 14 because the product surface area is small. However, as illustrated in FIGS. 1 and 5, shoe plate 26 is not a continuous ring, it is made of segments that must slide circumferentially against one another at a lap joint 302 as the floating roof 12 moves with respect to the side wall 14 to permit local changes in the dimension of the annular space 16.

At the top of the lap joints between adjoining shoe plates there could be a vertical gap created where excess flexible sheet 28 is required at the lap joints 302 to accommodate relative movement between the shoe plates and between a first fabric clamp 306 on the first shoe plate 26 and a second fabric clamp 308 on the second shoe plate 27. The fabric clamps join the flexible material 28 to the shoe plates. To minimize the escape of vapor through this gap, a gap seal 310 is provided with the present invention to further improve the sealing efficiency for floating roof tanks and is illustrated in FIGS. 5 and 6.

The gap seal 310 includes a flexible retainer strap 314 spanning the sliding lap joint 302 and secured to the first and second shoe plates 26 and 27 by the first and second fabric clamps 306 and 308, respectively. The retainer strap 314 and flexible sheet 28 are gathered over the sliding lap joint 302 to define a sleeve in which a resilient foam material 322 is packed which can be a closed-cell foam. As the first and second shoe plates 26 and 27 slide relative to one another, the retainer strap 314 and the flexible sheet 28 either tend to stretch flat or gather over the sliding lap joint 302 as illustrated in FIG. 6 and the resilient foam material 322 is compressed or allowed to expand. In this way, the sleeve in the flexible seal material 28 at the lap joint 302 between the shoe plates 26 and 27 is sealed to prevent the escape of vapor from the annular space 16.

Also illustrated in FIGS. 5 and **5*a* is the clip plate 29 which together with the first shoe plate 26 defines a resilient recess for slidably engaging the second shoe plate 27. The clip plate 29 is formed of a bent metal or molded plastic. It has an embossed foot 358 that is preferably bolted to the shoe plate 26 and an arm 360 that defines a recess 362 with the shoe plate. Internal stress within the clip plate 29 causes it to tend to close the recess 362. To assemble, the second shoe plate 27 is forced against an upturned lip 364 of the clip plate 29 to resiliently force open the recess 362 and allow the second shoe plate 27 to be inserted into the recess 362. The resiliency of the clip plate 29 resists separation of the shoe plates while permitting circumferential sliding, as indicated by the arrows in FIG. 5***a*.

The foregoing detailed description has been given for clearness of understanding only, and no unnecessary limitations should be understood therefrom.

What is claimed is:

1. A seal for a space between a floating roof and a side wall in a liquid storage tank comprising:

a) a first pantagraph hanger assembly joined to the floating roof;

b) a first shoe plate hung from the first pantagraph hanger assembly and in sliding contact with the side wall;

c) a second pantagraph hanger assembly joined to the floating roof;

d) a second shoe plate hung from the second pantagraph hanger assembly, and adjacent to and defining a sliding lap joint with the first shoe plate;

e) a clip plate fixed to the first shoe plate to define a resilient recess for slidably receiving the second shoe plate at the lap joint; and f) a flexible sheet material joined to the floating roof and to the first and second shoe plates to at least partially seal the space between the floating roof and the side wall, wherein the flexible sheet defines a gap at the sliding lap joint of the first and second shoe plates, and the seal further comprises;

g) a gap seal positioned in the gap to reduce vapor emissions through the gap, the gap seal comprising:

(i) a flexible retainer strap spanning the lap joint and secured to the first and second shoe plates to define a sleeve; and (ii) a resilient material packed in the sleeve to substantially reduce the emission of vapor through the sleeve.

2. A seal for a space between a floating roof and a side wall in a liquid storage tank comprising:

a) a first pantagraph hanger assembly joined to the floating roof;

(b) a first shoe plate hung from the first pantagraph hanger assembly and in sliding contact with the side wall;

c) a second pantagraph hanger assembly joined to the floating roof;

d) a second shoe plate hung from the second pantagraph hanger assembly, and adjacent to and defining a sliding lap joint with the first shoe plate;

e) a clip plate fixed to the first shoe plate to define a resilient recess for slidably receiving the second shoe plate at the lap joint; and f) a flexible sheet material joined to the floating roof and to the first and second shoe plates to at least partially seal the space between the floating roof and the side wall; and each pantagraph hanger assembly comprises:

(i) a base member fixed to the floating roof;

(ii) a pantagraph arm having a first end hinged to the base member and a second end free to pivot about the first end;

(iii) a hanger arm hinged to the pantagraph arm in an x-shaped configuration for scissor-like movement with the pantagraph arm, and having a first end hinged to a respective shoe plate, and a second end slidably bearing on the base member; and (iv) a coil spring compressed between the base member and the pantagraph arm to urge the second end of the pantagraph arm to pivot and the first end of the hanger arm away from the base member.

3. A modular pantagraph assembly for urging a shoe plate away from a floating roof of a liquid storage tank comprising:

a) a base member having means for being fixed to the floating roof;

b) a pantagraph arm having a first end hinged to the base member and a second end free to pivot about the first end;

c) a hanger arm hinged to the pantagraph arm in an x-shaped configuration for scissor-like movement with the pantagraph arm, and having a first end for applying a force to a shoe plate, and a second end slidably bearing on the base member; and d) a coil spring compressed between the base member and the pantagraph arm for urging the second end of the pantagraph arm to pivot and the first end of the hanger arm away from the base member.

4. The modular pantagraph assembly of claim 3 in which the base member is a channel having a web and two flanges extending outwardly toward the pantagraph and hanger arms.

5. The modular pantagraph assembly of claim 3 in which the base member includes a wing opposing a tube socket on the pantagraph arm, and the coil spring is compressed between the wing and the tube socket.

6. The modular pantagraph assembly of claim 3 in which the base member defines a slot and the second end of the hanger arm includes a pin received in the slot for sliding engagement.

7. A modular pantagraph assembly for urging a shoe plate away from a floating roof of a liquid storage tank comprising:

a) a base member having means for being fixed to the floating roof;

b) a pair of substantially parallel pantagraph arms each having first ends hinged to the base member and each having second ends free to pivot about the hinged first ends;

c) a hanger arm interposed between and hinged to the pantagraph arms in an x-shaped configuration for scissor-like movement with the pantagraph arms, and having a first end for applying a force to a shoe plate and a second end slidably bearing on the base member; and d) a pair of compression springs, one each compressed between the base member and a respective pantagraph arm for urging the second ends of the pantagraph arms to pivot and the first end of the hanger arm away from the base member.

8. The modular pantagraph assembly of claim 7 in which the base member is a channel having a web and two flanges extending outwardly toward the pantagraph and hanger arms.

9. The modular pantagraph assembly of claim 7 in which the base member includes a pair of wings joined to opposite sides of the base member and a tube socket joined to each wing, each tube socket opposes a wing joined to a respective pantagraph arm for receiving a coil spring therebetween.

10. The modular pantagraph assembly of claim 7 in which the base member defines a slot and the second end of the hanger arm includes a pin received in the slot for sliding engagement.

11. A seal for a space between a floating roof and a side wall in a liquid storage tank comprising:

a) first and second shoe plates hung from the floating roof, and positioned adjacent one another to define a sliding lap joint therebetween;

b) a pantagraph assembly joined to the floating roof and applying a force to the lap joint to urge the first and second shoe plates toward the side wall; and c) a flexible sheet material joined to the floating roof and to the first and second plates to at least partially seal the space between the floating roof and the side wall, wherein the flexible sheet defines a gap at the sliding lap joint of the first and second shoe plates, and the seal further comprises;

g) a gap seal positioned in the gap to reduce vapor emissions through the gap, the gap seal comprising:

(i) a flexible retainer strap spanning the lap joint and secured to the first and second shoe plates to define a sleeve; and (ii) a resilient material packed in the sleeve to substantially reduce the emission of vapor through the sleeve.

* * * * *